US006991550B1

(12) United States Patent
Zeilinger et al.

(10) Patent No.: US 6,991,550 B1
(45) Date of Patent: Jan. 31, 2006

(54) CLIMBING STEPS FOR PLAYGROUND STRUCTURE

(75) Inventors: Brian K. Zeilinger, Janesville, WI (US); Matthew T. Bolland, Stoughton, WI (US); Christopher D. Boll, Janesville, WI (US)

(73) Assignee: PlayStar, Inc., Janesville, WI (US)

( * ) Notice: Subject to any disclaimer, the term of this patent is extended or adjusted under 35 U.S.C. 154(b) by 0 days.

(21) Appl. No.: 10/940,309

(22) Filed: Sep. 14, 2004

(51) Int. Cl.
*A63G 21/04* (2006.01)

(52) U.S. Cl. ..... 472/116; 482/35; 182/198

(58) Field of Classification Search ..... 472/116, 472/117; 482/35–37; 182/194, 92, 198, 182/203, 178.1, 178.2
See application file for complete search history.

(56) References Cited

U.S. PATENT DOCUMENTS

| | | | | |
|---|---|---|---|---|
| 2,388,892 | A | 11/1945 | Wilson | |
| 3,472,509 | A * | 10/1969 | Flynn | 482/36 |
| 3,499,254 | A | 3/1970 | Jeffreys | |
| 3,572,698 | A | 3/1971 | Greenly | |
| D233,750 | S | 11/1974 | Gladstone | |
| 3,871,481 | A * | 3/1975 | Ballek | 182/151 |
| 4,199,040 | A * | 4/1980 | Lapeyre | 182/93 |
| 4,231,448 | A * | 11/1980 | Jensen | 182/93 |
| 4,252,313 | A * | 2/1981 | Skalka | 482/36 |
| 4,355,700 | A * | 10/1982 | Matthews et al. | 182/83 |
| 4,724,925 | A * | 2/1988 | Ritten | 182/97 |
| D295,222 | S | 4/1988 | Rudolph | |
| 4,772,011 | A * | 9/1988 | Guridi | 482/40 |
| D304,048 | S | 10/1989 | Freese | |
| D358,442 | S | 5/1995 | Houry et al. | |
| 5,496,232 | A * | 3/1996 | Morris et al. | 482/35 |
| 5,718,637 | A * | 2/1998 | Rodriguezx-Ferre | 472/116 |
| D418,189 | S | 12/1999 | Zeilinger | |
| 6,193,633 | B1 | 2/2001 | Jonas et al. | |
| 6,412,600 | B1 | 7/2002 | Wolfman | |
| 6,419,610 | B1 | 7/2002 | Jonas et al. | |

FOREIGN PATENT DOCUMENTS

FR 2 607 401 6/1988

OTHER PUBLICATIONS

Admitted Prior Art Step 2 Fold & Store Slide (Date Unknown), pp. 1-5.

(Continued)

*Primary Examiner*—Kien Nguyen
(74) *Attorney, Agent, or Firm*—Michael Best & Friedrich LLP

(57) ABSTRACT

A climbing steps rail set includes a first molded plastic rail having a lower end configured to rest on a lower support surface, an upper end configured to be coupled to an elevated support structure, and a first plurality of apertures formed in the rail and configured to receive respective first ends of steps to be supported by the rail set. The rail set further includes a second molded plastic rail having a lower end configured to rest on the lower support surface, an upper end configured to be coupled to the elevated support structure, and a second plurality of apertures formed in the rail and configured to receive respective second ends of the steps to be supported by the rail set.

20 Claims, 4 Drawing Sheets

OTHER PUBLICATIONS

Admitted Prior Art Rainbow Play Systems, Inc. Climbing Ladder (Date Unknown), pp. 1-3.
Admitted Prior Art PlayStar Contoured Leisure Swing (Apr. 29, 1999), p. 1 (with statement of relevance).
Admitted Prior Art Step 2 Climb Ladder (Date Unknown), p. 1.
Admitted Prior Art Little Tikes Easy Store Large Slide (Date Unknown), p. 1.

* cited by examiner

CLIMBING STEPS FOR PLAYGROUND STRUCTURE

FIELD OF THE INVENTION

The invention relates to children's playground equipment, and more particularly to climbing steps for playground equipment.

BACKGROUND OF THE INVENTION

Playground equipment often includes an elevated platform on which children can play, and from which they can access slides and other equipment. Typically, there are steps connected to the elevated platform so that children can climb up to the elevated platform from ground level.

SUMMARY OF THE INVENTION

The invention provides an improved climbing steps construction that is easy to assemble and install, and that is well-suited for the needs of the children using the steps.

More specifically, the invention provides a climbing steps rail set including a first molded plastic rail having a lower end configured to rest on a lower support surface, an upper end configured to be coupled to an elevated support structure, and a first plurality of apertures formed in the rail and configured to receive respective first ends of steps to be supported by the rail set. The rail set further includes a second molded plastic rail having a lower end configured to rest on the lower support surface, an upper end configured to be coupled to the elevated support structure, and a second plurality of apertures formed in the rail and configured to receive respective second ends of the steps to be supported by the rail set.

In one aspect of the invention, each of the rails includes a graspable handrail extending substantially the entire length of the rail from the lower end to the upper end. In another aspect of the invention, each of the rails includes a recessed pocket adjacent each of the plurality of apertures for facilitating the insertion of a fastener into a step received in the aperture. In yet another aspect of the invention, each of the rails includes a strengthening cavity formed in the rail.

The invention also provides a playstation including an elevated support structure positioned above a lower support surface, and climbing steps coupled to the elevated support structure for allowing a user to climb from the lower support surface to the elevated support structure. The climbing steps include a first molded plastic rail having a lower end configured to rest on the lower support surface, an upper end configured to be coupled to the elevated support structure, and a first plurality of apertures formed in the rail. The climbing steps further include a second molded plastic rail having a lower end configured to rest on the lower support surface, an upper end configured to be coupled to the elevated support structure, and a second plurality of apertures formed in the rail. Additionally, the climbing steps also include a plurality of steps positioned intermediate the first and second rails. Each step includes a first end received in a corresponding one of the first plurality of apertures, and a second end received in a corresponding one of the second plurality of apertures.

In one aspect of the invention, the width of the climbing steps is variable depending on the length of the plurality of steps positioned intermediate the first and second rails. In another aspect of the invention, the rails form about a sixty degree angle with the lower support surface. In yet another aspect of the invention, each of the rails has a body thickness along a substantial portion of the rail and a mounting portion at the upper end that is thinner than the body thickness. A transition between the body thickness and the thinner mounting portion defines a shoulder configured to align the rail for mounting to the elevated support structure. In yet a further aspect of the invention, the elevated support structure includes first and second generally vertical members. The shoulder of the first rail is generally aligned with an edge of the first generally vertical member and the shoulder of the second rail is generally aligned with an edge of the second generally vertical member.

Other features and advantages of the invention will become apparent to those skilled in the art upon review of the following detailed description, claims, and drawings.

Figure 1:
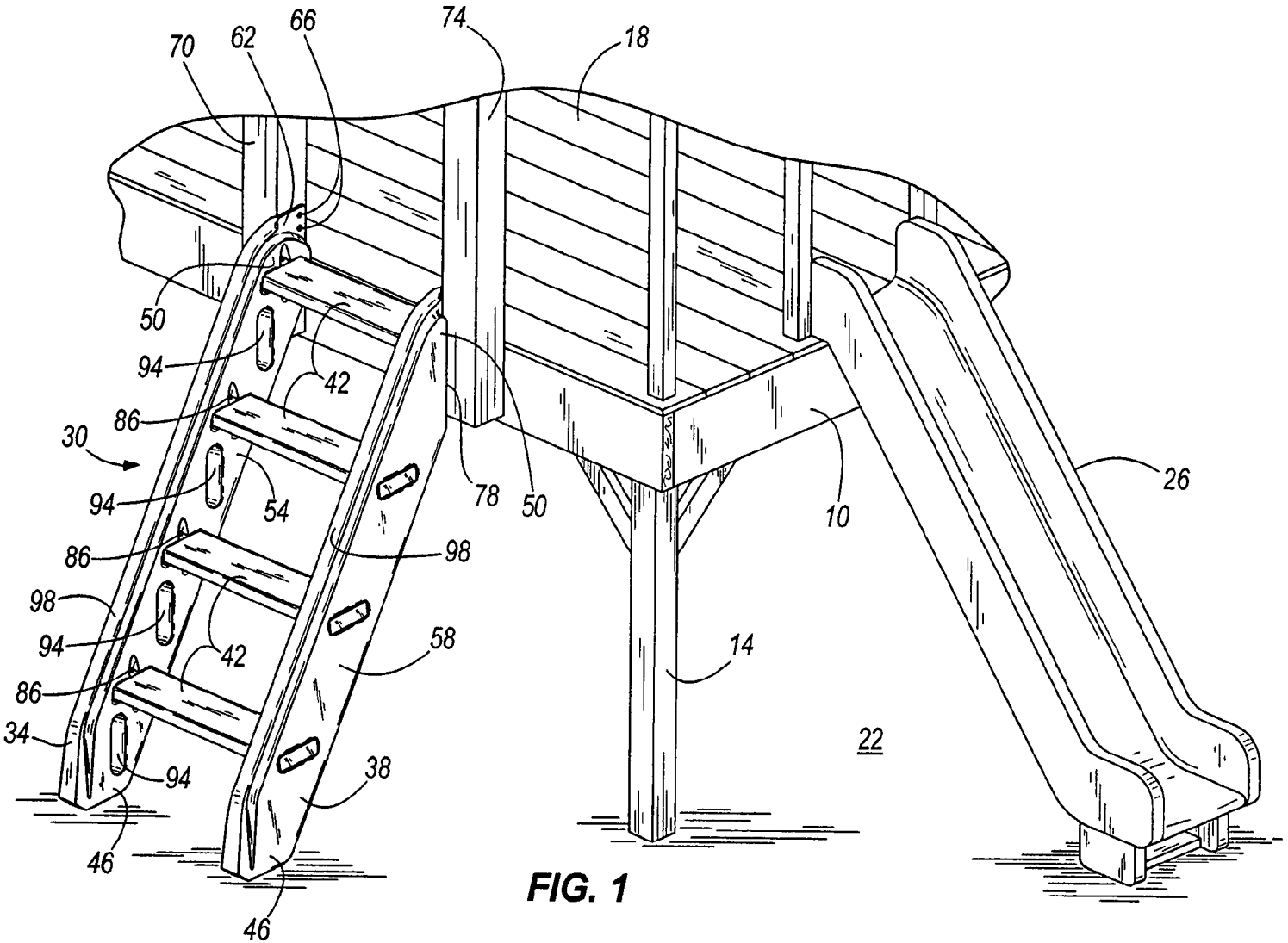
FIG. 1 is a partial perspective view of a playstation including climbing steps embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a playstation 10 of the type typically used by children for recreational play. The playstation 10 includes a plurality of legs 14 (only one is shown) that support an elevated support structure or platform 18 above a lower support surface, such as the ground 22. As shown, a slide 26 may be coupled to the playstation 10 to allow children to slide from the platform 18 down to the ground 22. While not shown, other rides and climbing features (e.g., swings, monkey bars, etc.) can also be coupled to the playstation 10.

Figure 2:
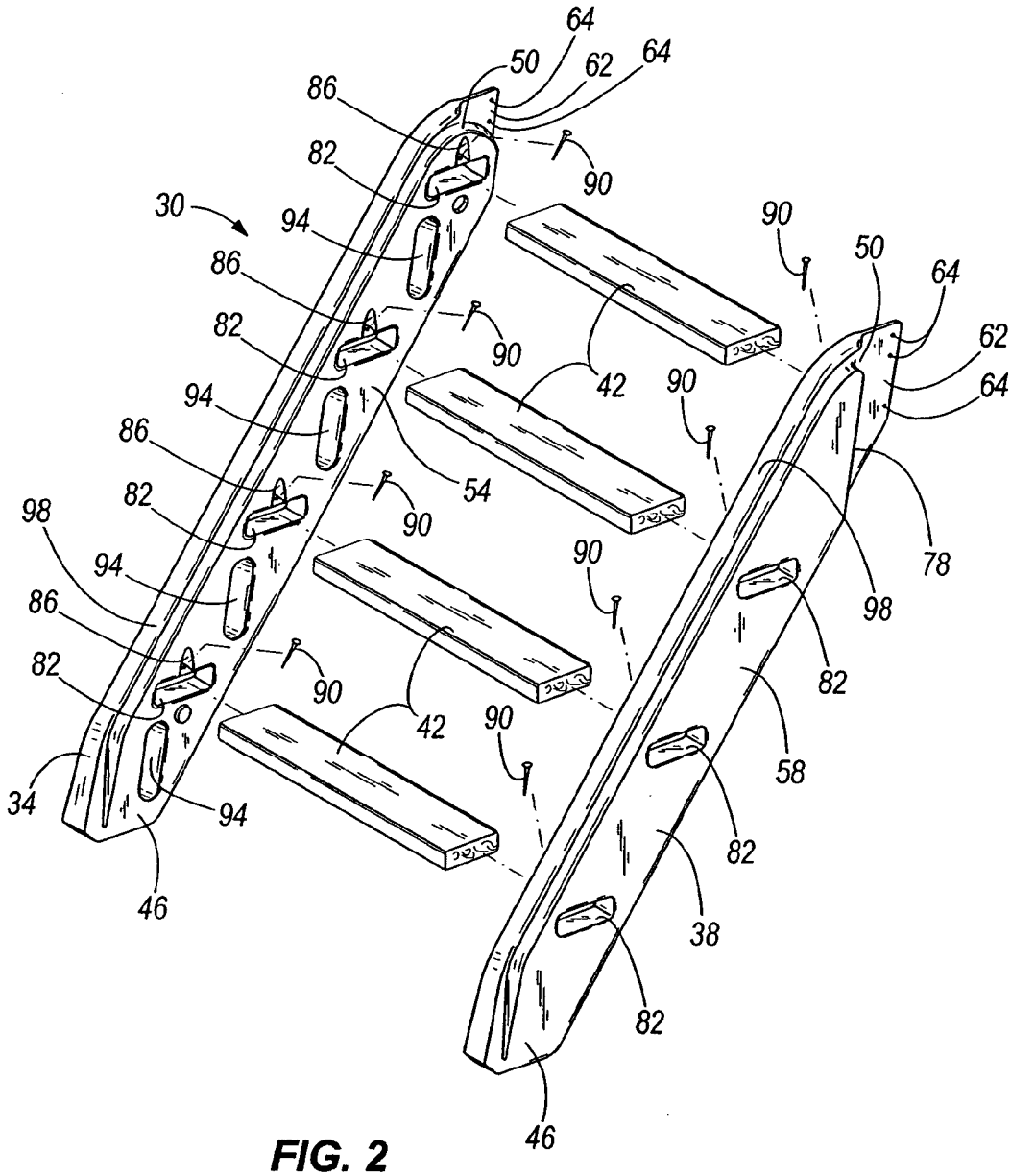
FIG. 2 is an exploded perspective view of the climbing steps shown in FIG. 1.

A set of climbing steps 30 is coupled to the playstation 10 to provide a way for children to climb from the ground 22 up to the platform 18. Of course, the climbing steps 30 can also be used to climb from the platform 18 back down to the ground 22. As best illustrated in FIG. 2, the climbing steps 30 are constructed of first and second one-piece, molded plastic rails 34, 38, respectively, which receive and support a plurality of steps 42 therebetween. In the illustrated embodiment, the rails 34, 38 are molded from a suitable plastic using a conventional blow molding technique. Of course, other suitable molding techniques (e.g., rotational molding) can also be used.

In the illustrated embodiment, the first rail 34 forms the left side of the climbing steps 30, while the second rail 38 forms the right side of the climbing steps 30. The first and second rails 34, 38 are substantially mirror images of one another, but are not interchangeable. In other words, the first rail 34 must be used as the left side rail of the climbing steps 30 and the second rail 38 must be used as the right side rail of the climbing steps 30. This facilitates construction and installation of the climbing steps 30 in that there is only one way to assemble the climbing steps 30 based on the construction of the rails 34, 38. Furthermore, by having distinct left and right rails, the assembled climbing steps 30 are more aesthetically pleasing. Of course, those skilled in the art will understand that the rails 34, 38 could also be modified such that each rail could be used as either a left-side or a right-side rail.

Figure 4:
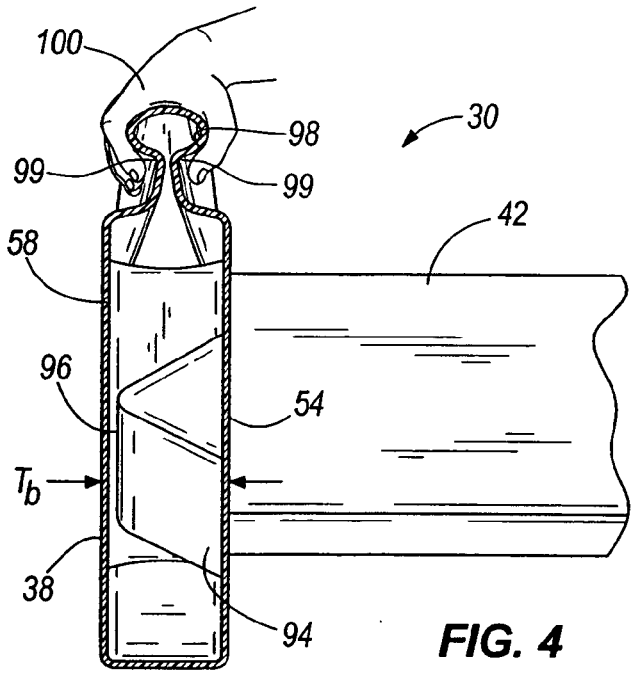
FIG. 4 is a section view taken along line 4—4 of FIG. 3.

Each rail 34, 38 includes a first or lower end 46 configured to rest on the ground 22, and a second or upper end 50 configured to be coupled to the platform 18. Each rail 34, 38 further includes an inner surface 54 and an outer surface 58. As best shown in FIG. 4, the inner and outer surfaces 54, 58 are spaced apart to define a rail body thickness $T_b$ that is generally constant over a substantial portion of each rail 34, 38. In the illustrated embodiment, the upper end 50 of each rail 34, 38 defines a mounting portion 62 that is thinner than the rail body thickness $T_b$ and that includes a plurality of apertures 64 configured to receive fasteners 66 (see FIG. 1) for securing the mounting portions 62 to respective first and second generally vertical members 70, 74 of the playstation 10. It should be noted that the vertical members 70, 74 could also extend to the ground 22 in a manner similar to the leg 14.

Figure 3:
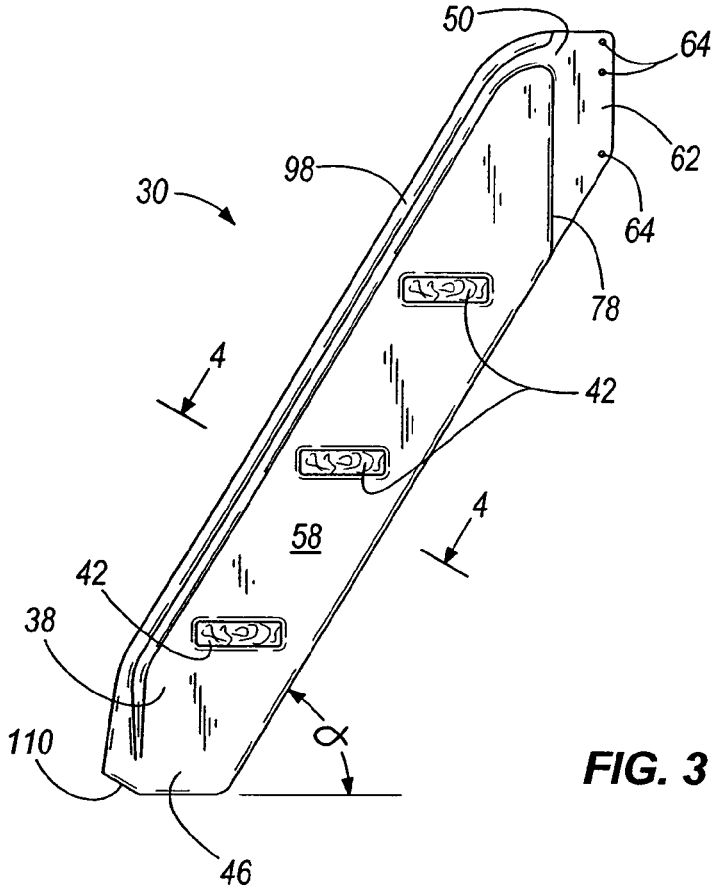
FIG. 3 is a right side view of the climbing steps shown in FIG. 1.

As best shown in FIG. 3, the transition between the portion of the rail 38 having the rail body thickness $T_b$ and the mounting portion 62 defines a shoulder 78 configured to align the rail 38 for mounting to the generally vertical member 74. As shown in FIG. 1, the generally vertical members 70, 74 are constructed of standard 4"×4" lumber. To align the mounting portions 62 of the rails 34, 38 for mounting, the rails 34, 38 are positioned as shown in FIG. 1 such that the shoulders 78 are generally aligned with and potentially even abut an outer edge or surface of the members 70, 74. Of course, the vertical members 70, 74 could also be made of other size lumber (e.g., 2"×4"s), in which case the shoulders 78 of the rails 34, 38 may not physically abut the vertical members. Nonetheless, the shoulders 78 will provide a visual alignment guide for positioning the mounting portions 62 properly with respect to the vertical members. The location of the apertures 64 on the mounting portions 62 is also selected such that the rails 34, 38 can be mounted to vertical members of differing sizes.

Figure 5:
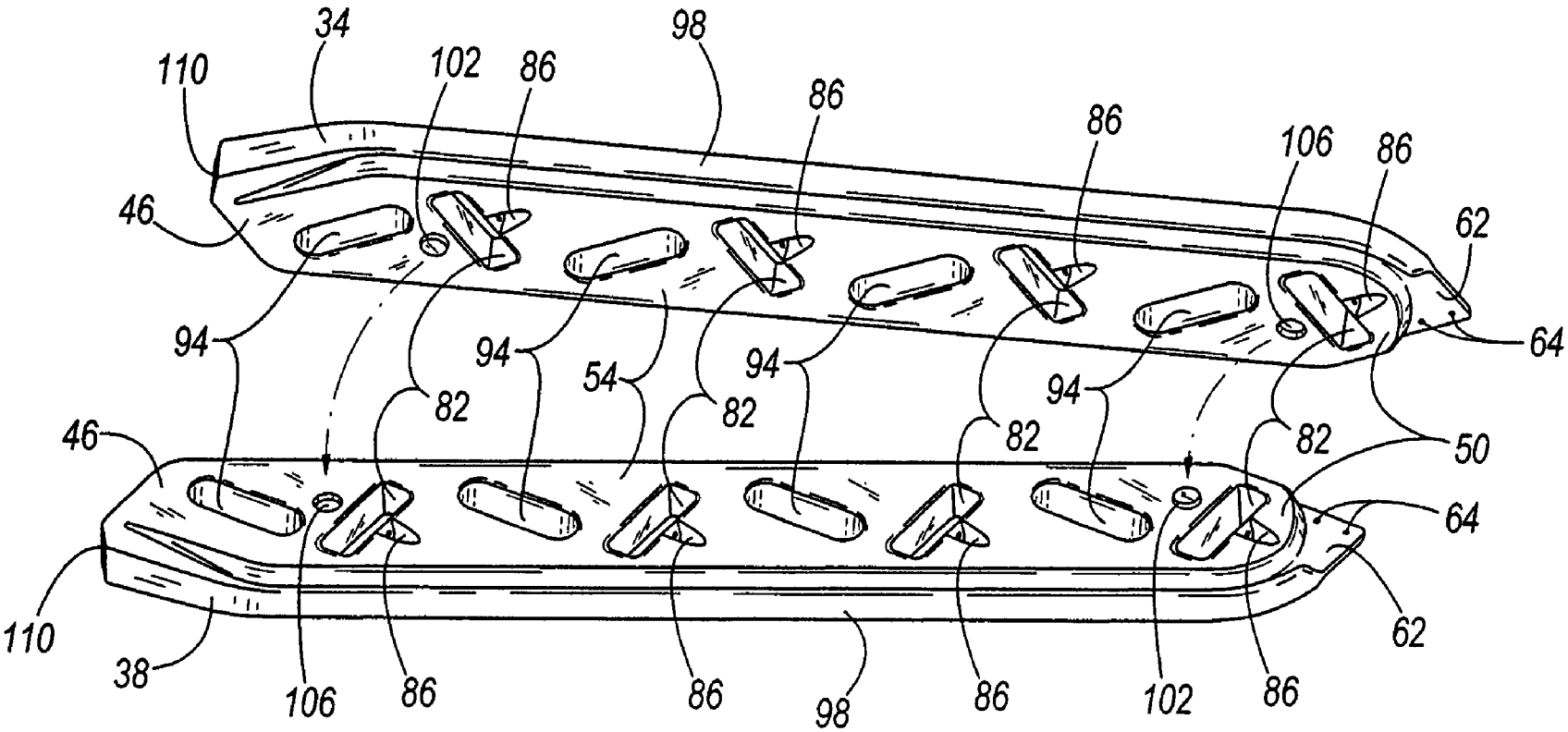
FIG. 5 illustrates the rails of the climbing steps without assembled steps.

As shown in FIGS. 2 and 5, each rail 34, 38 further includes a plurality of apertures 82 sized and configured to receive a respective end of a step 42. In the illustrated embodiment, the apertures 82 are each sized to receive an end of a step 42 constructed of standard 2"×6" lumber. As illustrated in the figures, the rails 34, 38 each include four, generally equally-spaced apertures 82, with the lower three apertures 82 extending completely through the rails 34, 38, and the upper-most aperture 82 not extending completely through the rails 34, 38. Of course, all of the apertures 82 could extend completely through the rails 34, 38, or likewise, none of the apertures 82 need extend completely through the rails 34, 38.

As shown in FIG. 1, the top step 42 is positioned in the rails 34, 38 such that its upper surface is generally aligned with the upper surface of the platform 18. With this configuration, the top step 42 forms an extension to the platform 18 that facilitates climbing and descending the climbing steps 30. Of course, the top step 42 need not be level with the upper surface of the platform 18, and in an alternative embodiment, the platform 18 can be located above the top step 42 such that the child takes an additional step up from the top step 42 to reach the platform 18.

Additionally, the number of apertures 82 in each rail 34, 38 can vary depending upon the desired number of steps 42 and the rails could receive and/or be modified to receive other sizes of steps 42 as well (e.g., 2"×4"s, 2"×10"s, etc.). However, benefits to using standard 2"×6" lumber as opposed to smaller 2"×4" lumber include larger horizontal stepping surfaces for a child's feet and reduced horizontal gaps between successive steps. It should also be noted that the steps 42 need not be constructed of wood, but can alternatively be constructed of other suitable materials, such as plastics.

Each rail 34, 38 also includes a recessed pocket 86 adjacent each aperture 82. The recessed pockets 86 facilitate the insertion of fasteners 90 (e.g., screws or nails—see FIG. 2) into the ends of the steps 42 to secure the ends of the steps 42 to the respective rails 34, 38. To assemble the steps 30, a first end of a first step 42 is inserted into an aperture 82 in the first rail 34. This procedure is repeated for each step 42. Next, the second end of each step 42 is inserted into the corresponding aperture 82 in the second rail 38. The fasteners 90 are inserted into the respective ends of the steps 42 within the recessed pockets 86 to secure the steps 42 in place with respect to the rails 34, 38.

The rails 34, 38 each also include molded-in strengthening cavities 94 formed between the apertures 82. A strengthening cavity 94 is also formed on each rail 34, 38 below the lower-most aperture 82. In the illustrated embodiment, the strengthening cavities 94 are generally oval-shaped adjacent the inner surfaces 54 and taper to an apex 96 (see FIG. 4). The cavities 94 are oriented substantially vertically. Of course, any suitable cavity shape and orientation can be used, and the number and location of the cavities 94 can be varied as desired.

As shown in FIG. 3, the rails 34, 38 are configured such that when mounted to the vertical members 70, 74, the rails form an angle $\alpha$ of about sixty degrees or less with the ground 22. In the illustrated embodiment, the angle $\alpha$ is about sixty degrees. Each of the rails 34, 38 is further constructed to include an integrally-formed graspable handrail 98 that extends substantially the entire length of the rail 34, 38 from the lower end 46 to the upper end 50. The handrail 98 is configured to meet ASTM F 1148-00 requirements for handgrasps, and provides a readily graspable component that a child 100 (see FIG. 4) can grasp through the entire climb or descent of the climbing steps 30. As best illustrated in FIG. 4, the handrail 98 is formed to include oppositely facing undercut portions 99 such that the child's fingers and thumb can wrap around a portion of the handrail 98 for improved grasping.

The rails 34, 38 provide great flexibility for varying the overall width of the climbing steps 30. As illustrated in FIG. 1, the assembled climbing steps 30 have an overall width of about twenty-four inches. This enables the four steps 42 to be cut from a single, eight-foot length of standard 2"×6" lumber. However, the overall width of the climbing steps 30 can be easily varied to any desired width dimension simply by using the appropriate length of wood for the steps 42.

The fact that the climbing steps 30 can be constructed at the site of the playstation 10, as opposed to being either pre-assembled or a single, molded unit further facilitates the ability to package the rails 34, 38 in a compact manner. As shown in FIG. 5, the rails 34 and 38 can be positioned and packaged such that the respective inner surfaces 54 engage one another. The inner surfaces 54 can each include interlock members in the form of a protrusion 102 and a recess 106. As seen in FIG. 5, the first rail 34 includes a protrusion 102 positioned near the lower end 46 and a recess 106 positioned near the upper end 50. The second rail 38 includes a protrusion 102 positioned near the upper end 50 to mate with the recess 106 in the first rail 34, and a recess 106 positioned near the lower end 46 to mate with the protrusion 102 on the first rail. These interlocking members help orient the rails 34, 38 with respect to one another and substantially prevent relative movement (e.g., sliding) between the rails 34, 38 when placed together for packaging. Of course, the specific locations, configurations, and numbers of interlocking members can be varied as desired.

The lower end 46 of the rails 34, 38 is also designed to facilitate storage and display of the rails 34, 38 prior to assembly. As best shown in FIG. 3, the lower end 46 of each rail 34, 38 includes an angled surface 110 that is inclined from the remainder of the lower surface configured to rest on the ground 22. The angled surface 110 is generally normal to long edges of the rails 34, 38 such that when the rails 34, 38 are standing generally vertically (i.e., the long edges of the rails are oriented generally vertically), the angled surface 110 provides a generally horizontal surface capable of supporting the rails 34, 38 in that generally vertical orientation. This feature is particularly useful for the storage and display of packaged rail sets in retail stores.

Various features of the invention are set forth in the following claims.

What is claimed is:

1. A climbing steps rail set comprising:

a first molded plastic rail having a lower end configured to rest on a lower support surface, an upper end configured to be coupled to an elevated support structure, and a first plurality of apertures formed in the rail and configured to receive respective first ends of steps to be supported by the rail set; and a second molded plastic rail having a lower end configured to rest on the lower support surface, an upper end configured to be coupled to the elevated support structure, and a second plurality of apertures formed in the rail and configured to receive respective second ends of the steps to be supported by the rail set;

wherein each of the rails includes an integrally-formed graspable handrail extending substantially the entire length of the rail from the lower end to the upper end; and wherein each of the rails includes a recessed pocket adjacent each of the plurality of apertures for facilitating the insertion of a fastener into a step received in the aperture.

2. The climbing steps rail set of claim 1, wherein at least one of the first plurality of apertures and at least one of the second plurality of apertures extends entirely through the respective first and second rails.

3. The climbing steps rail set of claim 1, wherein at least one of the first plurality of apertures and at least one of the second plurality of apertures does not extend entirely through the respective first and second rails.

4. The climbing steps rail set of claim 1, wherein each of the rails has a body thickness along a substantial portion of the rail and a mounting portion at the upper end that is thinner than the body thickness.

5. The climbing steps rail set of claim 4, wherein a transition between the body thickness and the thinner mounting portion defines a shoulder configured to align the rail for mounting to the elevated support structure.

6. The climbing steps rail set of claim 1, wherein the first and second rails each include an interlock member configured to orient the first and second rails with respect to one another for packaging and to substantially prevent relative movement between the rails.

7. The climbing steps rail set of claim 1, wherein each of the rails includes a strengthening cavity formed in the rail.

8. A playstation comprising:

an elevated support structure positioned above a lower support surface; and climbing steps coupled to the elevated support structure for allowing a user to climb from the lower support surface to the elevated support structure, the climbing steps including;

a first molded plastic rail having a lower end configured to rest on the lower support surface, an upper end configured to be coupled to the elevated support structure, and a first plurality of apertures formed in the rail;

a second molded plastic rail having a lower end configured to rest on the lower support surface, an upper end configured to be coupled to the elevated support structure, and a second plurality of apertures formed in the rail; and a plurality of steps positioned intermediate the first and second rails, each step including a first end received in a corresponding one of the first plurality of apertures, and a second end received in a corresponding one of the second plurality of apertures;

wherein each of the rails includes an integrally-formed graspable handrail extending substantially the entire length of the rail from the lower end to the upper end; and wherein each of the rails receives a plurality of fasteners to secure each step in the respective aperture.

9. The playstation of claim 8, wherein the steps are made of wood.

10. The playstation of claim 9, wherein the steps are made from standard 2"×6" lumber.

11. The playstation of claim 8, wherein the width of the climbing steps is variable depending on the length of the plurality of steps positioned intermediate the first and second rails.

12. The playstation of claim 8, wherein the rails form about a sixty degree angle with the lower support surface.

13. The playstation of claim 8, wherein each of the rails includes a recessed pocket adjacent each of the plurality of apertures, the recessed pocket receiving a fastener that secures the step in the adjacent aperture.

14. The playstation of claim 8, wherein each of the rails has a body thickness along a substantial portion of the rail and a mounting portion at the upper end that is thinner than the body thickness.

15. The playstation of claim 14, wherein a transition between the body thickness and the thinner mounting portion defines a shoulder configured to align the rail for mounting to the elevated support structure.

16. The playstation of claim 15, wherein the elevated support structure includes first and second generally vertical members, and wherein the shoulder of the first rail is generally aligned with an edge of the first generally vertical member and the shoulder of the second rail is generally aligned with an edge of the second generally vertical member.

17. A playstation comprising:

an elevated support structure positioned above a lower support surface; and climbing steps coupled to the elevated support structure for allowing a user to climb from the lower support surface to the elevated support structure, the climbing steps including;

a first molded plastic rail having a lower end configured to rest on the lower support surface, an upper end configured to be coupled to the elevated support structure, and a first plurality of apertures formed in the rail;

a second molded plastic rail having a lower end configured to rest on the lower support surface, an upper end configured to be coupled to the elevated support structure, and a second plurality of apertures formed in the rail; and a plurality of steps positioned intermediate the first and second rails, each step including a first end received in a corresponding one of the first plurality of apertures, and a second end received in a corresponding one of the second plurality of apertures;

wherein each of the rails receives a plurality of fasteners to secure each step in the respective aperture.

18. The playstation of claim 17, wherein each of the rails includes a recessed pocket adjacent each of the plurality of apertures, the recessed pocket receiving at least one of the plurality of fasteners to secure the step in the adjacent aperture.

19. A climbing steps rail set comprising:

a first molded plastic rail having a lower end configured to rest on a lower support surface, an upper end configured to be coupled to an elevated support structure, and a first plurality of apertures formed in the rail and configured to receive respective first ends of steps to be supported by the rail set; and a second molded plastic rail having a lower end configured to rest on the lower support surface, an upper end configured to be coupled to the elevated support structure, and a second plurality of apertures formed in the rail and configured to receive respective second ends of the steps to be supported by the rail set;

wherein the first and second rails each include an interlock member configured to orient the first and second rails with respect to one another for packaging and to substantially prevent relative movement between the rails.

20. A playstation comprising:

an elevated support structure positioned above a lower support surface; and climbing steps coupled to the elevated support structure for allowing a user to climb from the lower support surface to the elevated support structure, the climbing steps including;

a first molded plastic rail having a lower end configured to rest on the lower support surface, an upper end configured to be coupled to the elevated support structure, and a first plurality of apertures formed in the rail;

a second molded plastic rail having a lower end configured to rest on the lower support surface, an upper end configured to be coupled to the elevated support structure, and a second plurality of apertures formed in the rail; and a plurality of steps positioned intermediate the first and second rails, each step including a first end received in a corresponding one of the first plurality of apertures, and a second end received in a corresponding one of the second plurality of apertures;

wherein each of the rails has a body thickness along a substantial portion of the rail and a mounting portion at the upper end that is thinner than the body thickness;

wherein a transition between the body thickness and the thinner mounting portion defines a shoulder configured to align the rail for mounting to the elevated support structure; and wherein the elevated support structure includes first and second generally vertical members, and wherein the shoulder of the first rail is generally aligned with an edge of the first generally vertical member and the shoulder of the second rail is generally aligned with an edge of the second generally vertical member.

* * * * *